United States Patent [19]

Juarez et al.

[11] Patent Number: 4,533,144

[45] Date of Patent: Aug. 6, 1985

[54] ELECTRONIC GAME

[75] Inventors: Manuel Juarez, 1403 Valentine Rd., Kansas City, Mo. 64111; Neil Preston, Jackson County, Mo.

[73] Assignee: Manuel Juarez, Kansas City, Mo.

[21] Appl. No.: 512,590

[22] Filed: Jul. 11, 1983

[51] Int. Cl.[3] ..... A63F 9/02

[52] U.S. Cl. ..... 273/311; 273/310; 434/21; 434/22

[58] Field of Search ..... 273/310, 311; 434/16, 434/17, 19, 21, 22

[56] References Cited

U.S. PATENT DOCUMENTS

| | | | |
|---|---|---|---|
| 2,404,653 | 7/1946 | Plebanek | 273/311 |
| 2,957,693 | 10/1960 | Ross | 273/311 |
| 3,202,425 | 8/1965 | Van Hennik . | |
| 3,508,751 | 4/1970 | Meyer et al. | 273/310 |
| 3,549,147 | 12/1970 | Katter . | |
| 4,171,811 | 10/1979 | Meyer et al. | 273/310 |
| 4,266,776 | 5/1981 | Goldfarb | 273/310 |

*Primary Examiner*—Richard C. Pinkham
*Assistant Examiner*—Vincent A. Mosconi
*Attorney, Agent, or Firm*—Kokjer, Kircher, Bradley, Wharton, Bowman & Johnson

[57] ABSTRACT

An electronic game in which the game participant fires a hand held target weapon at targets and must evade simulated return fire directed at the person of the participant from hazard weapons. The targets include lamps which are momentarily energized one at a time by timing circuitry. The target weapon includes a trigger switch and a photosensor for detecting when the target weapon is accurately aimed at an energized target. Digital displays indicate the number of shots remaining and the number of target hits that have been recorded by the participant. The hazard weapons emit infrared beams at the body of the game participant and are activated one at a time by timing circuitry. The game is terminated when the participant has expended all of the allotted shots at the targets or when the beam from an activated hazard weapon is intercepted by the person of the game participant.

20 Claims, 9 Drawing Figures

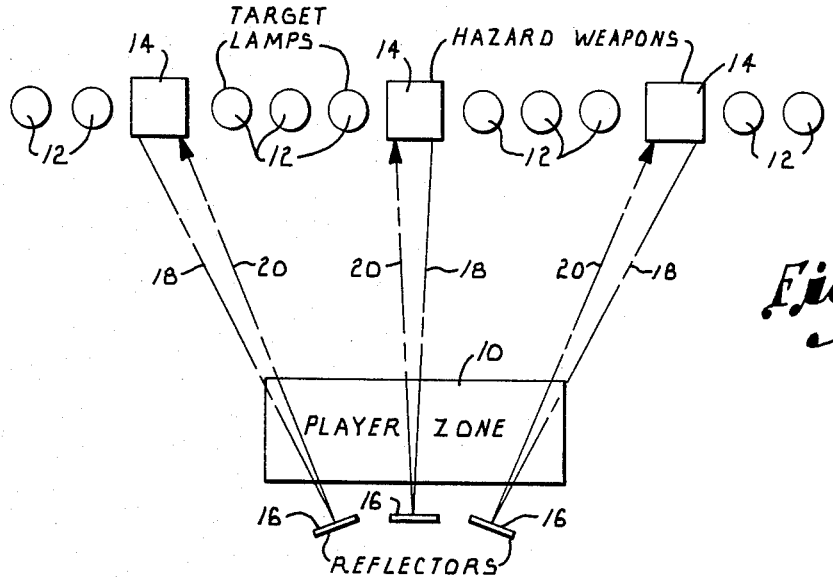
Fig. 1.
Fig. 2.
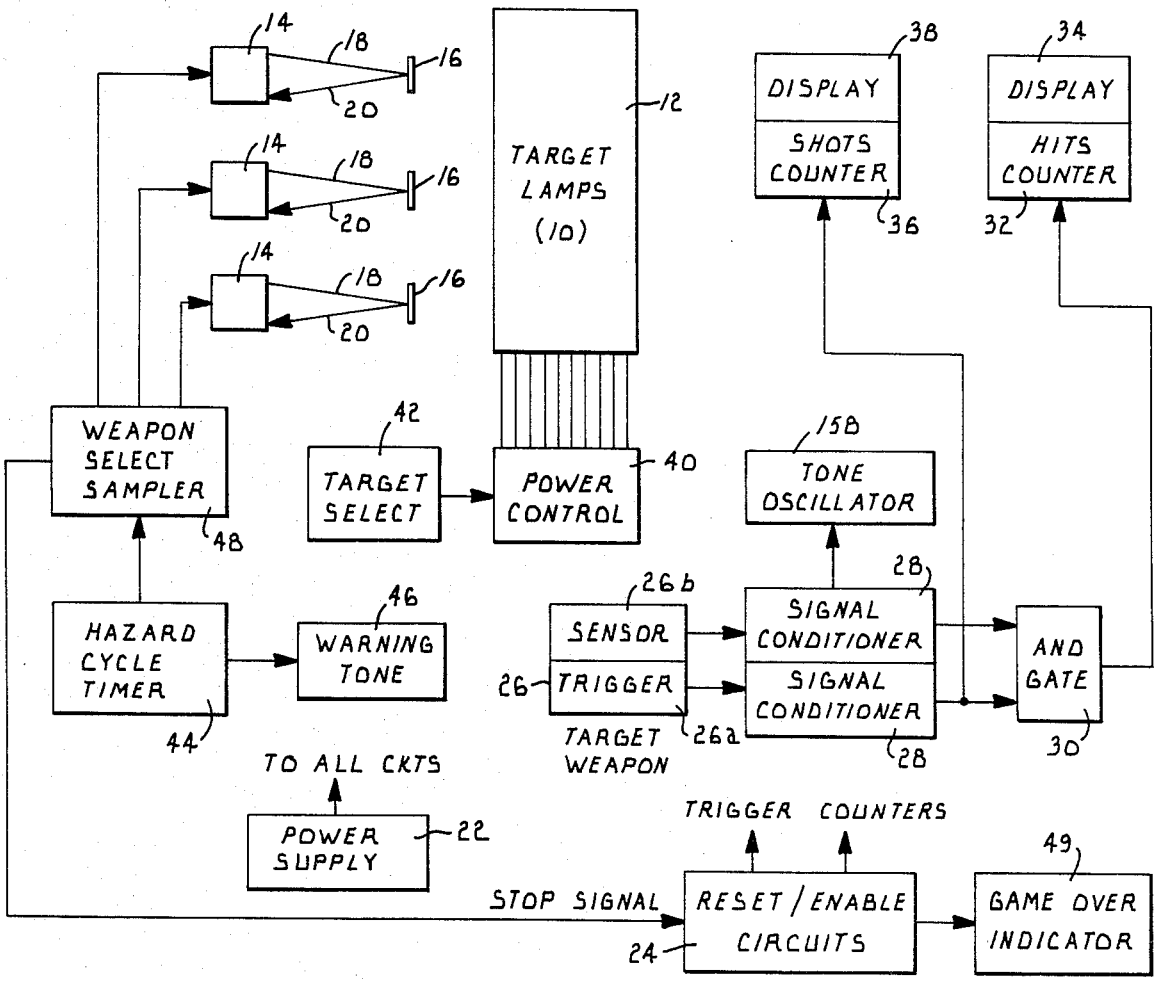

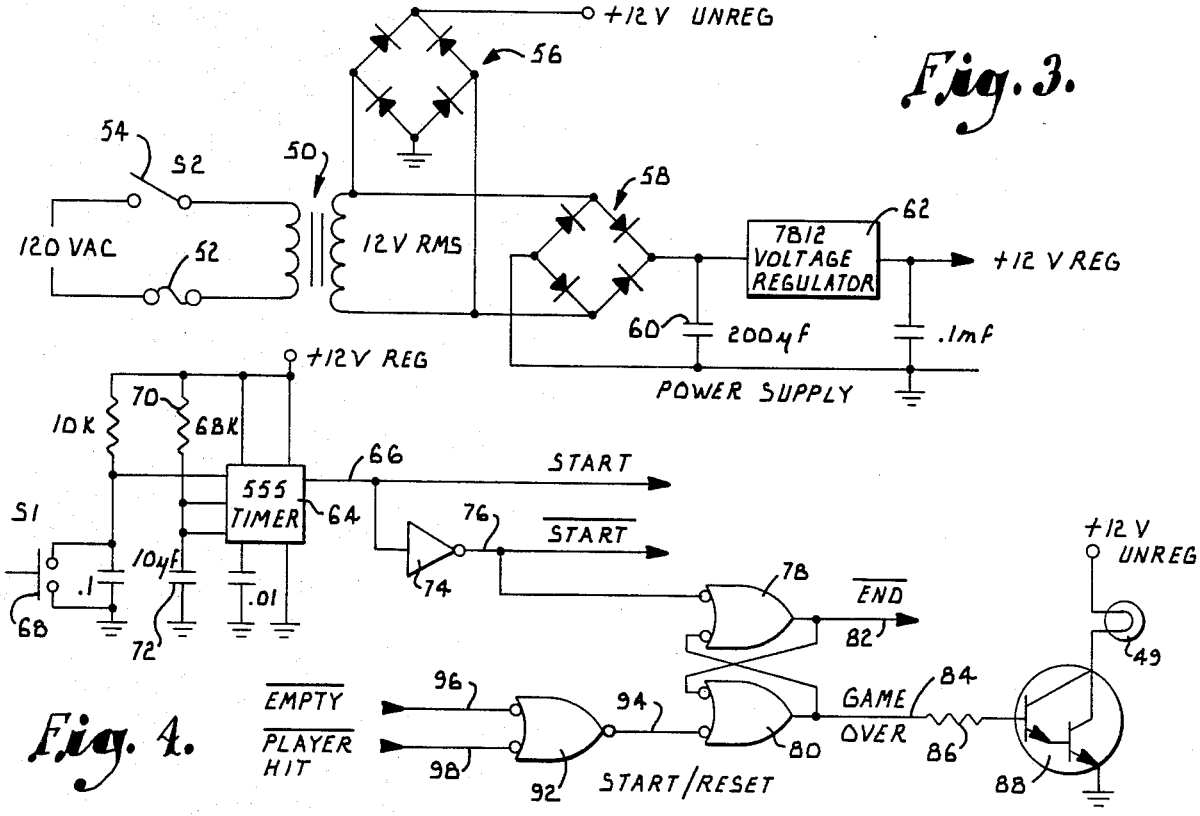
Fig. 3.
Fig. 4.
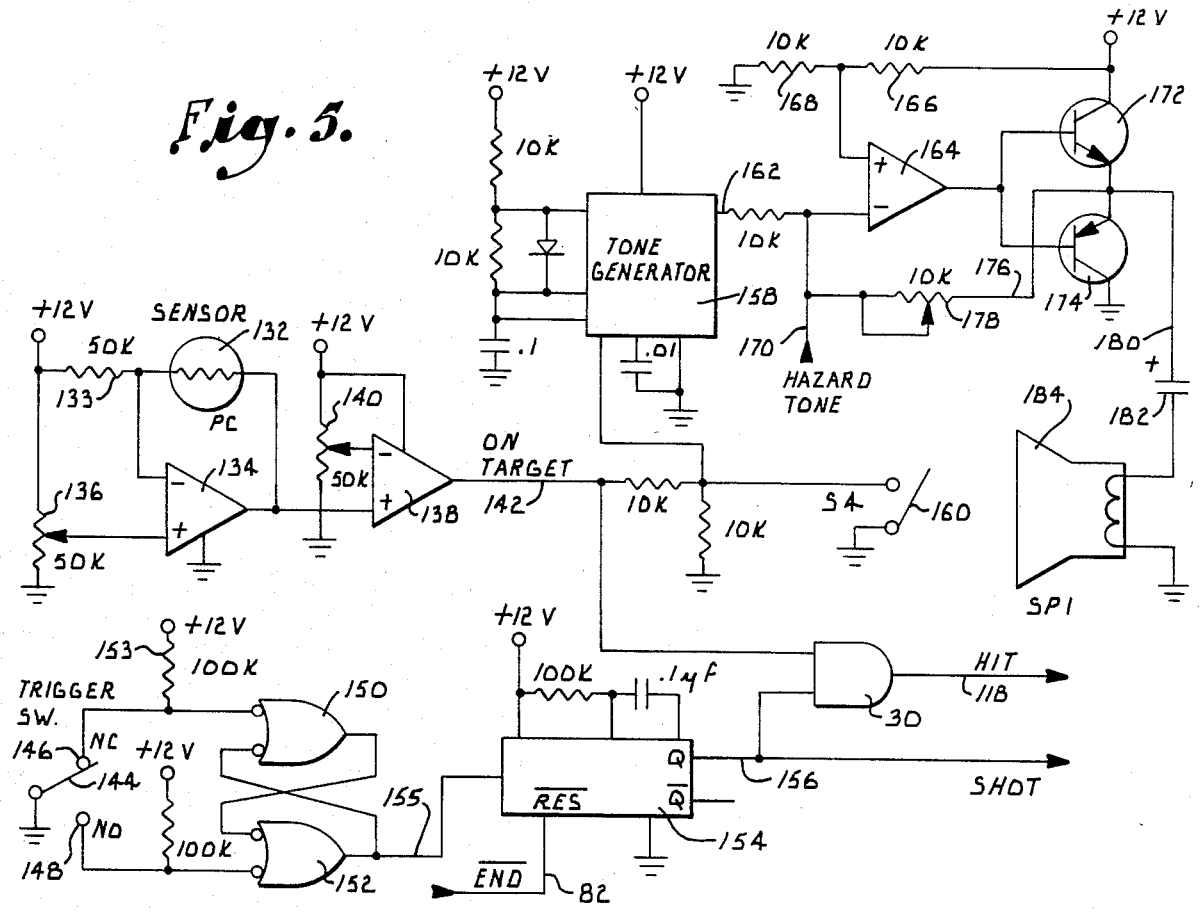
Fig. 5.

ELECTRONIC GAME

BACKGROUND AND SUMMARY OF THE INVENTION

This invention relates generally to electronic amusement devices and more particularly to an electronic game of skill in which the participant "shoots" at targets and is faced with simulated return fire directed toward his or her person.

The electronic games that have been developed in recent years have for the most part involved a video screen on which the player or players carry out various manipulations through control levers or knobs. Other types of amusement devices have been developed in which the participant "shoots" a beam of light at targets, as shown in U.S. Pat. No. 3,202,425 to Van Hennik and U.S. Pat. No. 4,266,776 to Goldfarb. In a somewhat similar manner, the gunnery training device shown in U.S. Pat. No. 3,549,147 to Katter et al includes simulated weapons that emit beams toward targets.

Frequently, either the machine or an opposing player can counterattack the player's weapon or his symbol on the playing screen, thereby requiring suitable manipulation of the controls to evade the counterattack. However, to our knowledge, no electronic game has been proposed having the capability of directing a counterattack at the actual person of the game participant. The present invention provides such a game and thereby requires the player to physically evade the counterattack.

It is the primary object of the invention to provide an electronic amusement game in which the game participant "shoots" a simulated weapon at targets while at the same time attempting to evade simulated return fire which is directed actually at the body of the player. In accordance with the invention, the game participant is stationed in a player zone which is relatively restricted in size. Targets situated away from the player zone take the form of individual lamps which are energized briefly one at a time in a random or apparently random sequence. The player has a hand weapon that is equipped with a photosensor and a trigger. If the weapon is accurately aimed at an energized target when the trigger is depressed, a target "hit" is recorded in favor of the player. The player is allotted a preselected number of shots, and the game ends when all of the shots have been expanded. A running total of the number of target hits is digitally displayed, as is the number of shots the player has remaining at any time.

It is an important feature of the invention that return "shots" are periodically fired at the person of the player. The return shots can originate either from the targets or from separate hazard weapons that direct infrared beams toward the player zone in a preferred form of the invention. Reflectors situated behind the player receive the beams and reflect them back to receivers in the hazard weapons unless the body of the player is in the path of an active beam, in which case the beam is intercepted. Then, the receiver fails to receive the reflected beam and a player hit is recorded, ending the game in favor of the machine.

Suitable electronic components and circuitry are provided to perform all of the required functions in an effective yet economical manner. Preferably, an audible warning tone is given immediately before each beam emission from one of the hazard weapons. The number and arrangement of the targets and hazard weapons can be varied virtually without limitation.

DESCRIPTION OF THE DRAWINGS

In the accompanying drawings which form a part of the specification and are to be read in conjunction therewith and in which like reference numerals are used to indicate like parts in the various views:

FIG. 1 is a diagrammatic plan view showing the general layout of an electronic game constructed in accordance with a preferred embodiment of the present invention;

FIG. 2 is a block diagram of the circuitry for the electronic game;

FIG. 3 is a schematic diagram of the power supply circuitry of the electronic game;

FIG. 4 is a schematic diagram of the initialization circuitry of the electronic game;

FIG. 5 is a schematic diagram of the target weapon and signal conditioning circuitry of the electronic game;

DETAILED DESCRIPTION OF THE INVENTION

Figure 6:
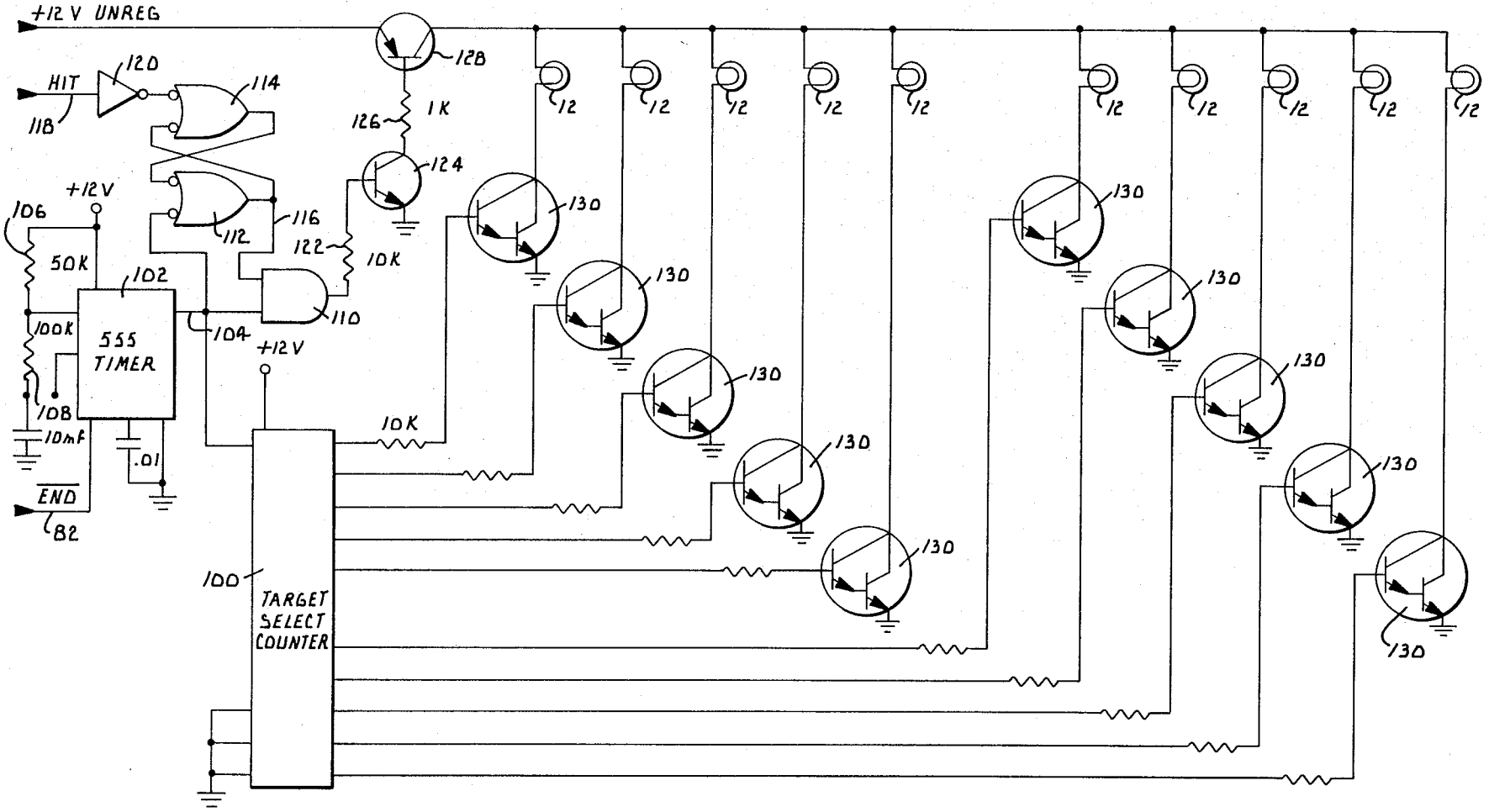
FIG. 6 is a schematic diagram of the target control circuitry of the electronic game.

Referring now to the drawings in more detail and initially to FIG. 1, the electronic game of the present invention is played by a game participant who stands in a player zone 10. The player zone 10 is relatively limited in size; for example, it may be several feet wide and eight or ten feet long. However, it should be understood that the player zone can be virtually any size.

Situated outside of the player zone are a plurality of targets 12 which preferably take the form of target lamps that are briefly energized one at a time, as will be explained more fully. The target lamps 12 can be arranged in any desired pattern, and any number of lamps can be provided. It is contemplated that the target lamps 12 will be mounted on fanciful figures. The player stationed in the player zone 10 carries a hand held target weapon (not shown) which is used to "shoot" at the energized target lamps 12. The target weapon can be a simulated handgun having a suitable finger or thumb operated trigger for "firing" of the weapon when depressed. In one form of the invention, the target weapon has a tubular barrel equipped with a lens which focuses light on a photocell when the barrel is accurately aimed at an energized target lamp.

Also situated outside the player zone are a plurality of hazard weapons 14 which function to direct simulated "return fire" toward the player zone 10. Each hazard weapon 14 has a reflector 16 which is located behind the player zone 10 or on the opposite side of the player zone from the hazard weapon. The hazard weapons are aimed at the reflectors 16, and each hazard weapon 14 emits an infrared beam 18 which is directed toward a portion of the player zone and the corresponding reflector 16. If the beam 18 is not intercepted by the body of the game participant, it reaches the corresponding reflector 16, and a reflected beam 20 is directed from the reflector back toward the originating hazard weapon 14. If the reflected beam is received by the hazard weapon 14, the beam has missed the player.

Referring now to the block diagram of FIG. 2, the electronic game includes a power supply 22 which provides power to all of the circuitry. Initialization circuitry 24 operates at the start of each game to reset the various counters and enable the trigger circuits of the target weapon. Target weapon circuitry 26 associated with the hand held target weapon includes a trigger circuit 26*a* and a sensor circuit 26*b*. The signals from these circuits are conditioned by conditioning circuitry 28 and applied as the two inputs to an AND gate 30 which in turn operates a hits counter 32 and an associated visual display 34. The display 34 digitially displays the number of target hits the player has achieved. The conditioned signal from the trigger circuitry 26*a* operates a shots counter 36 and associated visual display 38 which displays the number of shots remaining to the player. The target lamps 12 are operated by power control circuitry 40 and target select circuitry 42. The hazard weapon circuitry is controlled by a hazard cycle timer 44 which operates a warning tone generator 46 to provide a warning tone immediately prior to each "return shot" fired from one of the hazard weapons 14. The particular hazard weapon 14 that emits a beam is controlled by a hazard weapon select circuit 48. At the end of each game, a game over indication appears on an indicator 49 which is preferably a lamp.

FIG. 3 illustrates schematically the power supply circuitry 22. Ordinary 120 volt AC line voltage is reduced to 12 volt RMS AC power by a transformer 50. The primary side of the transformer includes a fuse 52 and a switch 54 which can be opened in order to remove power from the system and closed to supply power. A bridge rectifier 56 converts the 12 volt RMS alternating current to unfiltered pulsating DC current used by the target lamps 12 and the game over indicator lamp. Another bridge rectifier 58 produces direct current which is filtered by a capacitor 60 and regulated to 12 volts DC by a regulator circuit 62. The regulated 12 volt power is used by the control circuitry to provide operating power.

The initialization circuitry shown in FIG. 4 includes a 555 timer circuit 64 which provides a positive pulse on its output line 66 when power is first applied and thereafter when a start switch 68 is closed. The pulse applied to line 66 is a start pulse having a duration set by the values of a resistor 70 and a capacitor 72. The start switch 68 is a momentary contact push button switch.

The start pulse on line 66 is applied to an inverter 74 which provides an inverted or $\overline{\text{start}}$ pulse on its output line 76. The $\overline{\text{start}}$ pulse on line 76 is applied to one of the NAND inputs of a NAND gate 78 which, together with another NAND gate 80 forms a latch circuit. A low signal on line 76 sets the latch circuit and provides a high signal on a $\overline{\text{end}}$ line 82 which is the output line of gate 78. The output line 84 of the other NAND gate 80 is a game over line which is connected through resistor 86 to the base of a Darlington transistor 88. Plus 12 volts is applied to the collector of transistor 88 through the game over indicator lamp 49. When the game over line 84 is in a low state, transistor 88 is nonconductive and lamp 49 is deenergized. However, when the game over line is in a high state, transistor 88 is conductive, and the game over lamp 49 is energized to provide a visual indication of the end of the game.

Resetting of the latch formed by gates 78 and 80 is accomplished via an AND gate 92 having its output line 94 connected with one of the inputs to gate 80. The two inputs to gate 92 are applied on an $\overline{\text{empty}}$ line 96 an a $\overline{\text{player hit}}$ line 98.

Referring now to FIG. 6, the target lamps 12 are controlled by a target select counter circuit 100 and a 555 timer circuit 102 which is connected to function as an astable multivibrator. Circuit 102 is enabled by a high signal on the $\overline{\text{end}}$ line 82. When enabled, circuit 102 provides on its output line 104 a repeating rectangular waveform having a pulse width and pulse interval controlled by the values of a pair of resistors 106 and 108. The values of these resistors may be adjusted as desired, or they may be replaced by potentiometers which would permit the pulse width and pulse interval to be varied continuously. In one embodiment of the invention, the waveform on line 104 has a pulse width of approximately one second and a pulse interval of approximately 0.75 second.

Line 104 drives the target select counter 100 and is also connected with one input of an AND gate 110. Additionally, line 104 connects with one of the inputs of a NAND gate 112 which, together with another NAND gate 114, forms a latch circuit. A low signal on line 104 sets the latch circuit and places its output line 116 in a high state. Line 116 forms the second input to the AND gate 110. The latch circuit is reset by a high signal on a target hit line 118 which connects with an inverter 120 having its output side connected with one of the inputs to gate 114.

The output side of AND gate 110 connects through resistor 122 with the base of a transistor 124. The emitter of transistor 124 is connected with system ground, and its collector is connected through resistor 126 with the base of another transistor 128. Transistor 128 receives +12 volts (unregulated) on its emitter side, and its collector side connects with each of the target lamps 12 which are arranged in parallel. Each target lamp 12 is in series with a Darlington transistor 130 controlled by the target select counter 100. Each time the target select counter is incremented (due to a high signal on line 104), it provides a high signal on one of its output lines, thereby saturating the corresponding target driver transistor 130. If transistor 128 is conductive at the same time, the corresponding target lamp 12 is energized.

The target weapon circuits are shown in FIG. 5. The hand held target weapon is equipped with a photocell 132. The target weapon also has a lens (not shown) which focuses light on the photocell 132 when the target weapon is accurately aimed at a light source such as an energized target lamp 12. Power from the +12 volt source is applied through resistor 133 to the photocell 132 and to the inverting input of an amplifier 134. The output line from amplifier 134 is connected with the non-inverting input of a comparator 138. Potentiometers 136 and 140 are used as variable voltage dividers to establish reference voltages for the amplifier 134 and comparator 138. The inverting input of comparator 138 connects with the +12 volt source through a potentiometer 140. Comparitor 138 has an on target output line 142 which connects with one input of the AND gate 30 included in the target weapon circuitry.

When the target weapon is accurately aimed at an active target lamp 12, the lens in the target weapon focuses the light on the photocell 132, and its resistance then decreases sufficiently to provide an output from amplifier 134 that is above the threshold of the comparator 138 (as set by potentiometer 140). The on target line 142 is then placed in a high state. Conversely, if the weapon is inaccurately aimed or is not aimed at a target light that is energized, the relatively high resistance of the photocell 132 keeps the output line from amplifier 134 below the threshold of comparator 138, and the on target line 142 is then in a low state.

With continued reference to FIG. 5, the hand held target weapon has a trigger switch 144 which is a single pole, double throw momentary contact switch. A normally closed contact 146 is connected with system ground when the trigger switch 144 is not depressed. When the trigger switch is depressed, a normally open contact 148 connects with system ground. A pair of NAND gates 150 and 152 form a latch circuit which conditions the switch signal to eliminate the effects of switch contact bounce. The normally closed contact 146 connects with one of the inputs of gate 150, and the same input is also connected with +12 volts through a resistor 153. Similarly, the normally open contact 148 is connected with one of the inputs to gate 152.

The output signal from the latch circuit formed by gates 150 and 152 is applied via line 155 to a monostable multivibrator 154 which is enabled by the $\overline{\text{end}}$ line 82. The Q output pin of circuit 154 is connected with a shot line 156 which goes high each time the target weapon is triggered. Line 156 connects with the second input of AND gate 30. The output line of gate 30 is the hit line 118 which is applied to inverter 120 (see FIG. 6).

FIG. 5 also shows a testing and adjustment circuit which can be used to test the aim of the target weapon. A tone generator 158 is enabled when a high signal is present on the on target line 142. The tone generator is disabled when the on target line 142 is low, indicating that the weapon is inaccurately aimed. If a test switch 160 is closed, the tone generator 158 is disabled regardless of the state of the on target line 142.

When the tone generator 158 is enabled, it provides a tone signal on its output line 162 which connects with one input of an audio amplifier 164. A voltage divider formed by resistors 166 and 168 connects with the +12 volt source and applies a constant voltage to the other input of amplifier 164. The inverting input of amplifier 164 also connects with a hazard tone line 170.

The output side of amplifier 164 connects with the bases of a pair of transistors 172 and 174. A feed back line 176 having a potentiometer 178 is connected between the transistors and extends to connection with the inverting input of the audio amplifier 164. Also connected between the transistors 172 and 174 is a speaker line 180 which connects through a capacitor 182 with an audio speaker 184 having its other side connected with system ground.

Figure 9:
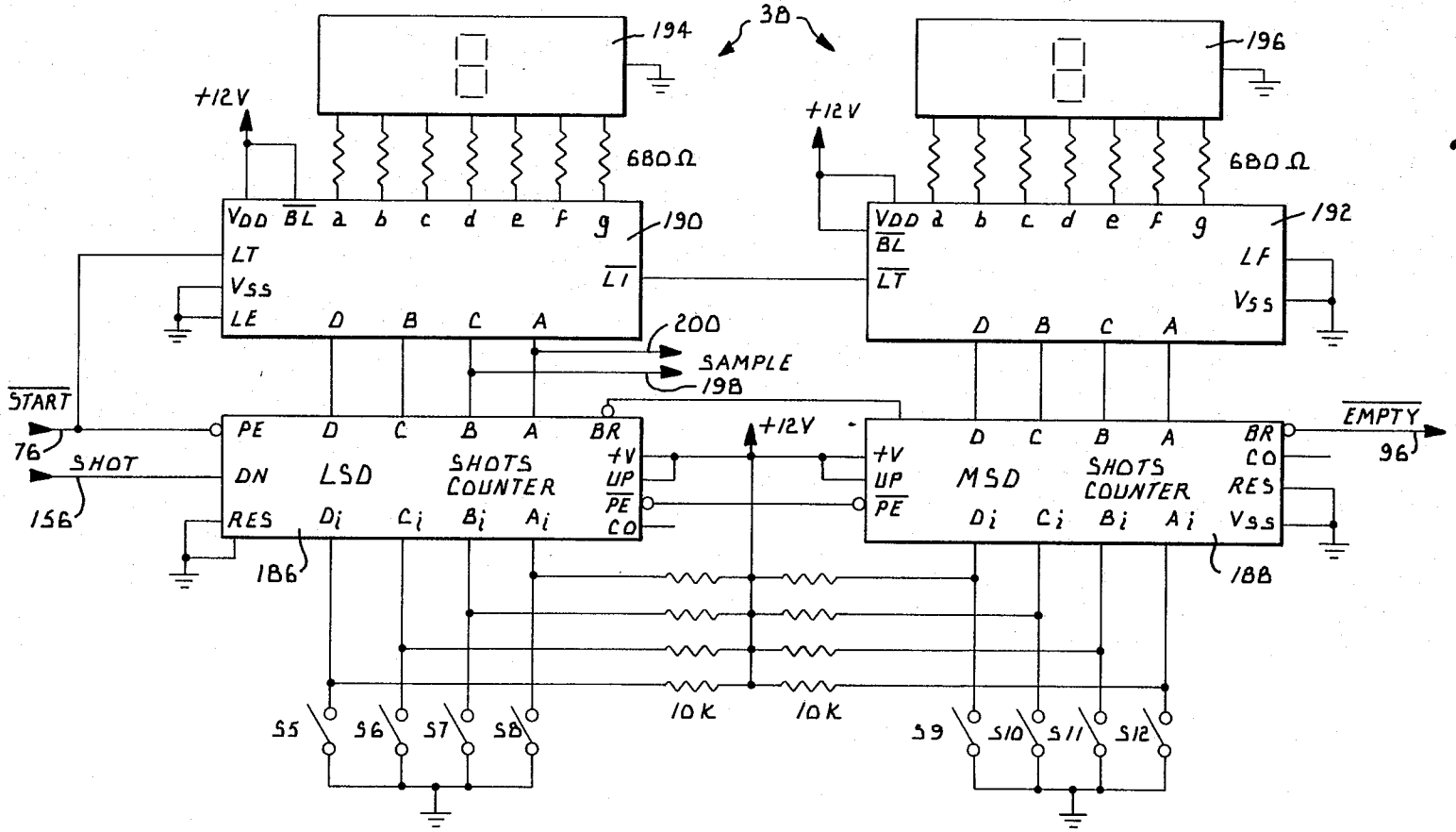
FIG. 9 is a schematic diagram of the shots counter and visual display of the electronic game.

The ammunition counter and display circuitry shown in FIG. 9 includes a pair of counters 186 and 188 which correspond to the least significant digit and most significant digit, respectively. The total number of shots that are allotted during the course of the game can be set by the game operator by properly setting a series of switches S5–S12 associated with the counters 186 and 188. A standard binary code is used for the switch settings. Signals indicative of the contents of the counters 186 and 188 are applied to display drivers circuits 190 and 192 which decode the numbers in the counters and display the number of shots remaining to the player on digital displays 194 and 196 which together provide the shots remaining display 38.

The $\overline{\text{start}}$ line 76 connects with counter 186 and display driver 190 to load the ammunition counter when the start pulse is generated. The predetermined number of shots loaded into the counter upon start up is determined by the setting of switches S5–S12. Each time the trigger 144 of the target weapon is depressed, the shot line 156 goes high to decrement the counters 186 and 188. The number of shots remaining is displayed on the digital displays 38 The number of display 194 is the least significant decimal digit and that on display 196 is the most significant digit. When the counters 186 and 188 are decremented to zero, indicating that the player has expended all of the shots allotted to him, counter 188 generates a low pulse on the $\overline{\text{empty}}$ line 96. Until then, the $\overline{\text{empty}}$ line remains high.

The state of the two least significant digits of the ammunition counter is constantly monitored on sample lines 198 and 200 which connect between counter 186 and display driver 190. The purpose for this will subsequently be explained.

Figure 8:
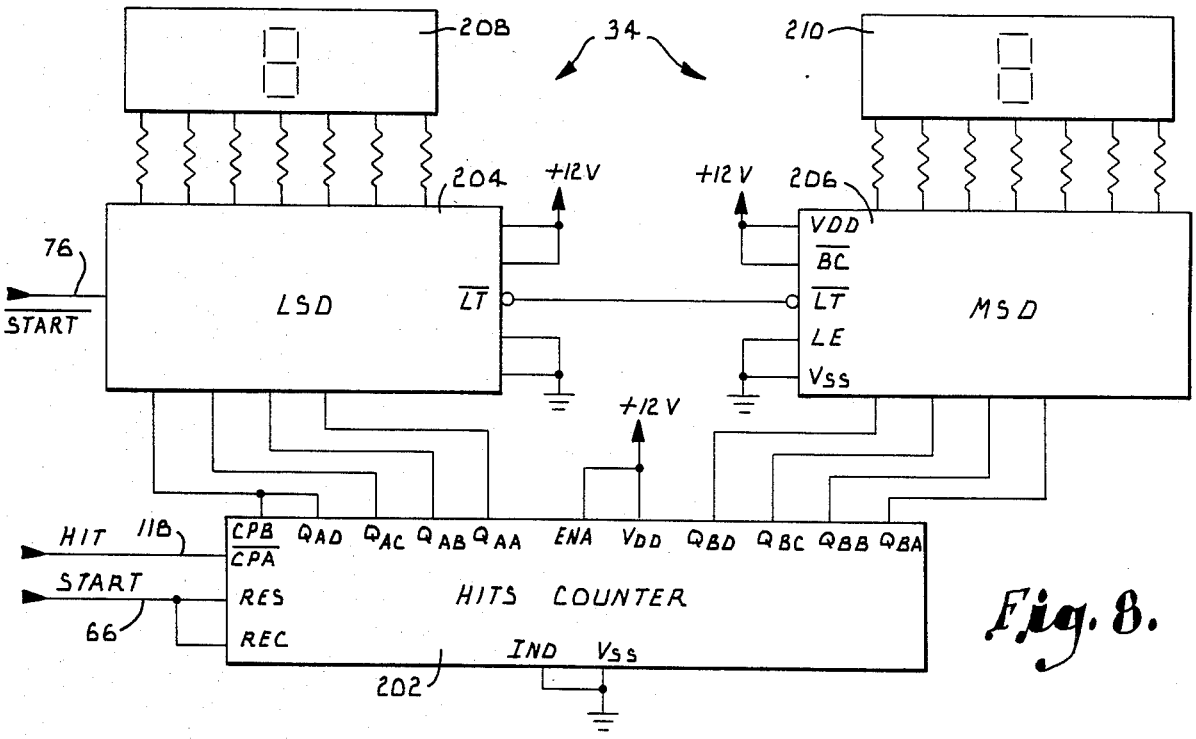
FIG. 8 is a schematic diagram of the target hits counting circuitry and visual display of the electronic game.

Referring now to FIG. 8, the target hits counter 32 includes a CD4518B counter circuit 202 which is cleared by the start signal on line 66. A pair of display drivers 204 and 206 decode the number in the hits counter 202 and display it on digital displays 208 and 210 which together form the hits display 34. The display is cleared by the $\overline{\text{start}}$ line 76 which connects with display driver 204. The hit line 118 connects with the hits counter 202 and causes counter 202 to increment each time line 118 goes high to indicate a hit on one of the target lamps 12.

Figure 7:
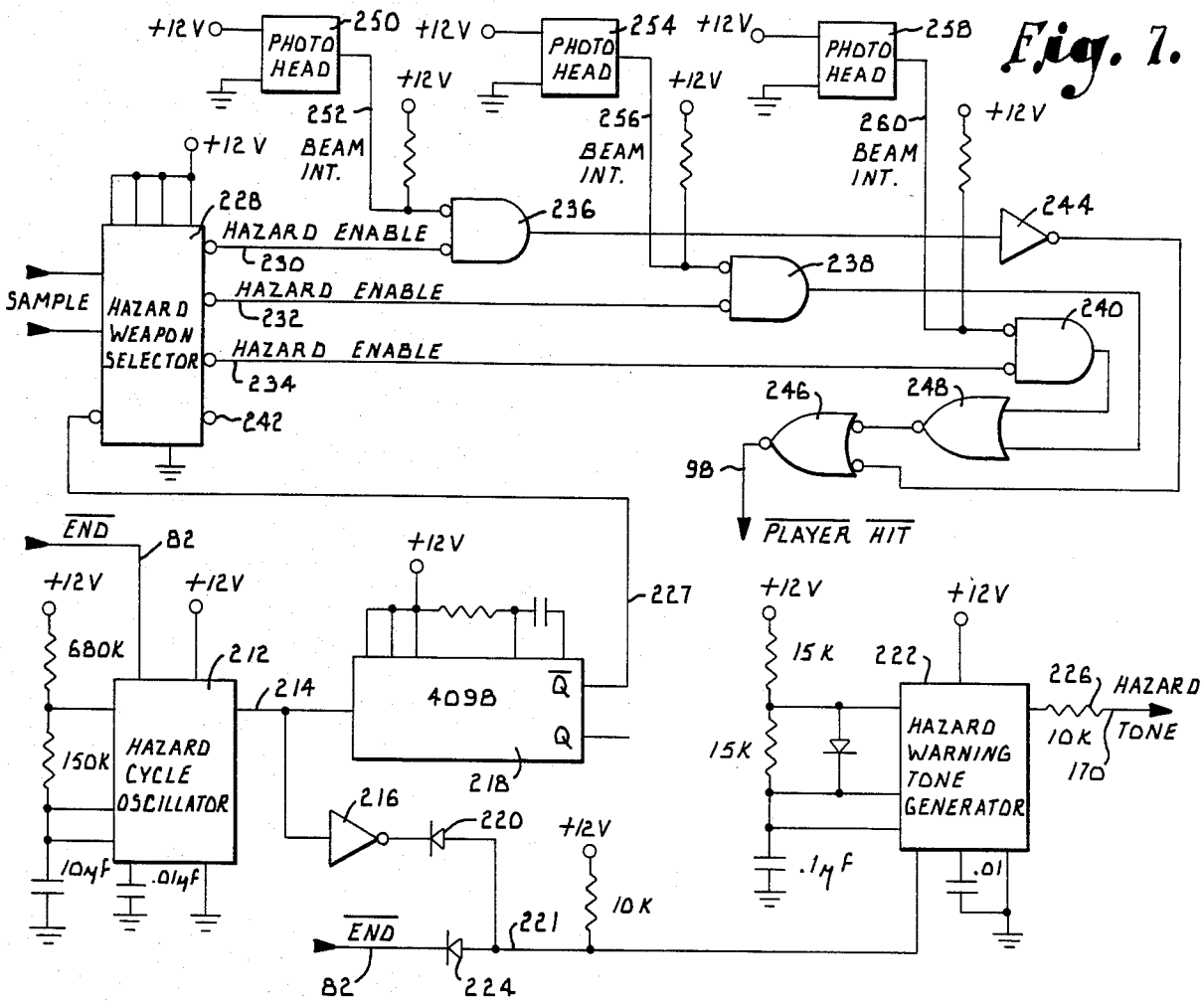
FIG. 7 is a schematic diagram of the hazard weapon circuity of the electronic game.

FIG. 7 shows the hazard weapon control circuitry which includes a hazard cycle oscillator 212 enabled by a high signal on the $\overline{\text{end}}$ line 82. The output line 214 of the oscillator 212 cycles high for approximately five seconds and then returns to the low state. Line 214 connects with an inverter 216 and also with the input of a monostable multivibrator 218. The output side of inverter 216 connects with a diode 220 to reverse bias the diode when the inverter output is high. The opposite side of diode 220 connects with a conductor 221 which extends to a hazard warning tone generator 222. Power is constantly available to line 221 so that the tone generator 222 is enabled when the output side of inverter 216 is high to reverse bias diode 220 and is disabled when the output side of the inverter is low to forward bias the diode. The $\overline{\text{end}}$ line 82 is also connected with line 221 through another diode 224 which is reverse biased so long as the $\overline{\text{end}}$ line remains high. The hazard warning tone generator 222 is disabled whenever the $\overline{\text{end}}$ line 82 is in a low state regardless of the condition of the inverter 216.

The output signal from the hazard warning tone generator is applied through resistor 226 to the hazard tone line 170. As previously indicated in connection with FIG. 5, the hazard tone line 170 connects with the non-inverting inut of the audio amplifier 164.

The $\overline{Q}$ output line 227 of the monostable multivibrator 218 is connected as an active low input to a hazard weapon selector 228. The sample lines 198 and 200 are also connected with the hazard weapon selector 228. The hazard weapon selector has four active low outputs. Three of the selector output lines 230, 232 and 234 are hazard enable lines which are active low lines that connect with inputs of respective NOR gates 236, 238 and 240. The fourth output 242 of the hazard weapon selector is unconnected and serves as a "blank" fired from the hazard weapons, as will be explained more fully.

The output side of NOR gate 236 is connected through an inverter 244 with one of the inverted inputs of an AND gate 246. The output sides of gates 238 and 240 connect with the two inuts of another NOR gate 248. The output signal from gate 248 is applied as the second input to gate 246. The output line of gate 246 is the $\overline{\text{player hit}}$ line 98.

The hazard weapons 14 are implemented using a retroflective infrared photoelectric control. The hazard weapons include "photohead" units which may be of the type available from the Photoswitch Corp. Cambridge, Mass., designated as Model No. 42DRU-5000. These photohead units are capable of being operated by +12 volts DC and provide an open collector output transistor for the output logic signal. The photoheads emit infrared beams which are reflected by the reflectors 16 if they are not intercepted by the body of the game participant. The output transistor turns on when the beam is intercepted, and the output signal from the photohead then goes low. When the player is clear of the beam, the reflected beam 20 is received by the photohead, and the output signal remains high. During operation of the game, each photohead continuously emits an infrared beam and continously provides an output signal (low if the player intercepts the beam, high otherwise).

With reference again to FIG. 7, one of the photoheads 250 is associated with NOR gate 236 and has a beam intercept output line 252 which connects with the second input to gate 236. Another photohead 254 has its beam intercept output line 256 connected with the second input to gate 238. Similarly, the third photohead 258 has its beam intercept output line 260 connected with the second input to NOR gate 240. All of the beam intercept lines 252, 256, and 260 constantly receive power through suitable pull-up resistors. It should be understood that any number of hazard weapons can be provided, and that the three photoheads described herein are set forth by way of example only.

The power supply circuitry and the electronic circuitry necessary to implement the features of the game are contained within a control unit (not shown) on which the digital displays 34 and 38 and the game over indicator lamp 49 are located. The control unit also includes the power control switch 54, the start switch 68 and the test switch 160. Preferably, the switches S5–S12 are located internally of the control unit. Cables are used to connect the target weapon, target lamps and hazard weapons with the control unit.

In use of the electronic game, the participant stands in the player zone 10 with the hand held target weapon. The game is initiated by closing switch 54 initially and thereafter by depressing the start switch button 68 on the control unit while switch 54 remains closed. A positive pulse is then generated on the start line 66 and the hits counter 202 (FIG. 8) is cleared.

The start pulse is inverted by the inverter 74 to provide a low $\overline{\text{start}}$ pulse on line 76. The $\overline{\text{start}}$ pulse on line 76 is applied to the ammunition counter circuit 186 (FIG. 9) to load into the ammunition counter a number (determined by the setting of switches S5–S12) representing the number of shots allotted to the player. The $\overline{\text{start}}$ pulse on line 76 is also applied to the display driver circuits and activates the display test function causing each of the displays 194, 196, 208 and 210 to energize all segments of the digital bar display for approximately one second so that any defective segments can be identified. At the end of the one second display period, the hits display is cleared to zero and the shots remaining display is loaded to indicate the total number of shots allotted to the game participant.

The low $\overline{\text{start}}$ pulse on line 76 is applied to one of the inverted inputs of gate 78 (FIG. 4) to thereby set the latch formed by gates 78 and 80. The $\overline{\text{end}}$ line 82 is then in a high state, and the game over line 84 is in a low state so that the game over indicator lamp 49 is deenergized. During the course of the game, the $\overline{\text{end}}$ line 82 remains in a high state to enable the trigger circitry (monostable multivibrator 154), the target sequence timer (timer circuit 102) and the hazard cycle oscillator 212. The $\overline{\text{end}}$ line 82 also permits the hazard warning tone generator 222 (FIG. 7) to be enabled under the control of the hazard cycle oscillator 212.

With reference to FIG. 6, when the timer 102 is enabled at the start of the game, its output line 104 begins to provide a repeating rectangular waveform having a pulse width of approximately one second and a pulse interval of approximately 0.75 seconds. When line 104 is in a low state, the AND gate 110 provides a low output signal which drives transistors 124 and 128 into cutoff, thereby removing power from all of the target lamps 12. The low signal on line 104 is also applied to gate 112 to set the latch formed by gates 112 and 114. When the latch is set, line 116 goes high and remains high so long as the latch is not reset (due to a hit on one of the target lamps 12).

When line 104 is subsequently cycled to the high state, both inputs to gate 110 are high, and the AND gate provides a high output signal which saturates both of the transistors 124 and 128. Power is then available through transistor 128 to all of the target lamps 12. The high pulse on line 104 also causes the target select counter 100 to increment so that one of the output lines of the target select counter provides a high signal to the base of the corresponding target driver transistor 130. The transistor is then saturated, and the corresponding target lamps 12 is energized. The lamp remains energized so long as both inputs to gate 110 remain high. If the player fires at and hits the active target lamps 12, the hit line 118 goes high to reset the latch circuit formed by gates 112 and 114. Line 116 then goes to a low state so that the active target lamp immediately reverts to the inactive state in the event it is "hit" by a "shot" from the target weapon. If the target is not hit, it remains energized until the end of the high pulse on line 104. Then, gate 110 is disabled and power is removed from the target lamps.

In this manner, the target lamps 12 are energized one at a time for a period of approximately one second, and there is an interval of approximately 0.75 second when all of the lamps are inactive. It should be understood that the timing sequence of the target lamps can be varied as desired by adjusting the values of resistors 106 and 108. The target lamps 12 are successively energized in a sequence controlled by the target select counter 100. Due to the relatively large number of target lamps (they are ten in number in one embodiment of the invention), the sequence in which the lamps are energized cannot be easily detected by the game participant, and it appears to the player essentially as a random sequence. Accordingly, the participant must be alert to any of the target lamps becoming active at any time. The target lamps continue to cycle on and off in this fashion throughout the course of the game. The lamps 12 can be physically rearranged to vary the sequence if necessary to prevent game participants from becoming familiar with the target pattern.

The game participant uses the hand held target weapon to fire at the energized target lamps 12 during the course of the game. With reference now to FIG. 5, the resistance of the photocell 132 decreases when the target weapon is accurately aimed at an active target lamp. This causes the output from amplifier 134 to rise above the threshold of comparator 138 as set by potentiometer 140. The on target line 142 then goes to a high state and provides one high input to AND gate 30. If the target weapon is not accurately aimed at an active target, the on target line 142 remains low because the output from amplifier 134 remains below the threshold set by potentiometer 140.

To "fire" at a target lamp, the trigger switch 144 is depressed by the game participant. This moves switch 144 to the normally open contact 148. The high output signal from the latch circuit formed by gates 150 and 152 is fed on line 153 to the monostable multivibrator 154 which is enabled by the high $\overline{\text{end}}$ signal on line 82, as previously indicated. The latch is used for switch contact conditioning to eliminate switch bounce. When the trigger switch 144 is released, line 153 returns low after it has been momentarily placed in a high condition by depression of the trigger switch.

The high signal on line 153 generates a short pulse on the Q output pin of circuit 154, thereby providing a high signal on the shot line 156. This shot signal causes the ammunition counters 186 and 188 to decrement, and the content of the ammunition counters is decoded by the display drivers 190 and 192. In this manner, each time the trigger switch 144 is depressed, the shots remaining display 38 is decremented to display the number of shots remaining to the game participant.

The shot line 156 also forms the second input to AND gate 30 (FIG. 5). If the trigger 144 is depressed at the same time as the target weapon is accurately aimed at an active target lamp 12, both inputs to gate 30 are high, and the hit line 118 is activated. The short positive pulse which is generated on the hit line 118 is applied to the hits counter 202 (FIG. 8). The hits counter is thereby incremented, and its contents are decoded by the display drivers 204 and 206 which display the total number of target hits that have been achieved on the hits display 34. As previously indicated, activation of the hit line 118 immediately causes the energized target lamp to deenergize due to resetting of the latch formed by gates 112 and 114.

Referring again to FIG. 5, it is contemplated that the test switch 160 will normally be closed during the course of the game. Then, the tone generator 158 is disabled. In order to test the aim of the target weapon, test switch 160 can be opened at selected times such as between games. With the test switch open as shown in FIG. 5, the tone generator 158 is enabled whenever the on target line 142 is in a high state (whenever the target weapon is accurately aimed at an active target lamp 12). When enabled, the tone generator applies a tone signal to its ouput line 162, and the audio amplifier 164 provides an amplified output signal which alternately saturates transistors 172 and 174 and causes speaker 184 to emit a tone indicating that the target weapon is on target.

When the target weapon is not on target, line 142 is in a low state, and the tone generator 158 is disabled.

The test switch 160 thus provides a testing and adjustment aid which permits the aim of the target weapon to be tested from time to time. If the test system indicates that there is a problem with the target weapon, the potentiometers 136 and 140 can be adjusted to correct the problem, or other corrective measures can be taken. If desired, the entire game can be played with switch 160 open so that the game participant will receive an audible signal whenever the target weapon is accurately aimed at an active target lamp 12. This facilitates playing of the game because inaccurate shots can be more easily avoided.

During the course of the game, the hazard weapons 14 emit infrared beams at the body of the player, and active beams must be evaded in order to avoid ending the game in favor of the machine. The hazard cycle oscillator 212 remains enabled by the $\overline{\text{end}}$ line 82 during the course of the game. The oscillator output line 214 cycles high and low and remains in the high state for approximately five seconds. When line 214 is in a low state, the $\overline{Q}$ output line 227 of the monostable multivibrator 218 is in a high state, and this high signal disables the hazard weapon selector 228. All of the output lines 230, 232 and 234 (as well as the fourth output 242) are then in a high state, and all of the NOR gates 236, 238 and 240 are inactive. The player $\overline{\text{hit}}$ line 98 is high, and game play continues.

The low state of the oscillator output line 214 reverse biases diodes 220 so that the hazard warning tone generator 228 is enabled (so long as diode 224 remains reverse biased due to a high signal on the $\overline{\text{end}}$ line 82). The hazard tone line 170 provides a tone signal to the audio amplifier 164 (FIG. 5). The speaker 184 then generates an audible warning signal advising the game participant that one of the hazard weapons is about to return fire at him. The duration of the warning tone is approximately one half second. The warning tone can be supplemented or replaced by a visual signal such as a flashing red light (not shown). The hazard warning tone has a different pitch than the on target tone so that the two tones are distinguished.

When the oscillator output line 214 returns to the high state, diode 220 is forward biased, and the hazard warning tone generator 222 is disabled. This terminates the warning tone. At the same time, the $\overline{Q}$ output of circuit 218 goes low for a few milliseconds, thereby enabling the hazard weapon selector 228. One of the active low hazard enable outputs of the hazard weapon selector is placed in a low condition for a few milliseconds.

The state of the sample lines 198 and 200 determines which of the hazard enable outputs is activated. The sample lines monitor the state of the two least significant bits of the ammunition counter 186 and apply to the hazard weapon selector signals representative of the least significant digit of the ammunition counter. If the least significant digit is zero, four, or eight, line 230 is placed in the low state. If the number is one, five, or nine, line 232 is placed in the low state. If the least significant digit of the amunition counter is two or six, line 234 is in the low state. Finally, the unconnected output pin 242 is placed in the low state if the digit three or seven is present.

If line 230 is selected, one input to NOR gate 236 is low for a few milliseconds to enable the gate. If the game participant is clear of the infrared beam emitted from photohead 250, line 252 remains high, and the second input to gate 236 is low, thereby maintaining the gate output in a low state. However, if the body of the player intercepts the beam from photohead 250, line 252 is placed in a low state, and gate 236 receives low signals at both the beam intercept and hazard enable inputs. The gate output goes high, resulting in a low output from inverter 244 applied to one of the inverted inputs of AND gate 246. The AND gate output line 98 ($\overline{\text{player hit}}$) then goes to a low state, indicating that the player has been hit by a "shot" from the hazard weapon.

As shown in FIG. 4, the low signal on the $\overline{\text{player hit}}$ line 98 is applied to one of the inputs of AND gate 92, making the output line 94 low. This low signal is applied to gate 80 and thereby resets the latch formed by gates 78 and 80. Resetting of the latch places the game over line 84 in a high state, making transistor 88 conductive and enrgizing the game over light 49 which gives a visual indication on the control unit that the game is over. At the same time, the $\overline{\text{end}}$ line 82 goes to a low state and disables the monostable multi-vibrator 154, the target timing circuit 102, the hazard cycle oscillator 212, and the hazard warning tone generator 222. The game is then ended immediately. The number of shots remaining and the number of target hits remain on the display 38 and 34.

When hazard enable line 232 is placed in a low condition by the hazard weapon selector 228, gate 238 is enabled and provides a high output if, at the same time, the beam emitted by photohead 254 is intercepted by the body of the player to place line 256 in a low condition. Then, the high output signal from gate 238 results in a low output from gate 248 and a low output from gate 246, again placing the $\overline{\text{player hit}}$ line 98 in a low condition. This immediately terminates the game in the manner previously indicated.

When the third hazard enable line 234 is low, gate 240 is enabled but remains inactive unless the beam emitted by photohead 258 is intercepted by the person of the player. Then, the beam intercept line 260 is placed in a low state and both inputs to gate 240 are low. The high output signal from the NOR gate 240 results in a low output signal from gate 248 and places the $\overline{\text{player hit}}$ line 98 in a low condition, terminating the game.

If the unconnected output 242 is selected, the $\overline{\text{player hit}}$ line 98 remains in a high state, regardless of the position of the game participant. The game is then allowed to continue and the selection of output 242 essentially results in the firing of the ineffective "blank" from the hazard weapons.

In this manner, the hazard weapons are periodically "fired" at the game participant, and if the player is then in the path of the beam emitted from the photohead associated with the activated hazard enable output line from the hazard weapon selector 228, the player is "hit" by the return fire from the hazard weapons, and the game is terminated immediately. Consequently, the player must avoid the return fire from the hazard weapons in order to continue playing the game. The hazard weapons are activated in what appears to the player to be a random sequence, so the player is not able to effectively anticipate which of the hazard weapons should be avoided at any given time. It should be understood that other methods of determining which hazard weapon "fires" at the player can be employed, and other timing patterns can be used.

Even if the game participant manages to avoid the hazard weapons, the game is terminated when all of the allotted shots have been fired at the target lamps 12. When the ammunition counters 186 and 188 have decremented to aero, the $\overline{\text{empty}}$ line 96 is placed in a low state, and this low signal is applied to one of the inputs to gate 92. Line 94 is then placed in a low state to reset the latch circuit formed by gates 78 and 80, thereby energizing the game over lamp 49 and placing the $\overline{\text{end}}$ line 82 in a low state to disable the targets, the target weapon, the hazard warning tone generator and the hazard weapons. The game is thus ended when the player has been "hit" by one of the hazard weapons or when he has expended all of the allocated ammunition, which ever occurs first. In either case, the number of target hits made by the player remains displayed on the hits display 34 to visually display the score achieved by the player.

As best shown in FIG. 1, the beams 18 emitted by the hazard weapons 14 are preferably directed to different areas of the player zone so that the game participant must move about in the player zone during the course of the game. Rather than being situated in stationary positions, the target lamps 12 or the hazard weapons 14, or both, can move (on tracks or the like) as the game progresses. Also, the return fire can originate from the target lamps 12 rather than from separate hazard weapons. The target lamps 12 and/or hazard weapons 14 can be arranged in any desired pattern throughout a full 360°, and virtually any number of targets and hazard weapons can be employed. Distinctive audio tones can be generated each time one of the target lamps 12 is hit or missed, and another tone can be generated from each of the hazard weapons that fires. Alternatively or in addition, the hazard weapons 14 can be provided with flashers that provide a visual indication that the weapon is being fired at the player, either simultaneously with the firing of the weapon or immediately prior thereto.

Although infrared beams are emitted from the hazard weapons in a preferred form of the invention, the hazard weapons can counterattack by firing an ultrasonic beam, a stream of fluid or a similar type of return fire in addition to or instead of the infrared beam. Relatively harmless projectiles such as ping pong balls or other soft objects can also be fired addition to or instead of the beam. It is contemplated that both the target lamps 12 and the hazard weapons 14 will be mounted on distinctive figures of various types. The game can be a coin operated device, as should be obvious to those skilled in electronic games.

It is to be understood that the control unit can be implemented by microprocessor based systems or by any other suitable mechanical or electronic means. It should also be recognized that selection of the active targets can be accomplished by a sampling system similar to that described for the hazard weapon selection, which samples the number of shots remaining to the player. In addition to amusement, the present invention can serve as a training device for law enforcement or military training.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, we claim:

1. Electronic game apparatus for use by a game participant stationed in a player zone of sufficient size to permit the participant to assume different positions in the player zone, said apparatus comprising:

a plurality of targets;

a target weapon for a game participant, said target weapon having trigger means for triggering the target weapon;

target hit indicating means for indicating when said target weapon is triggered while aimed at one of said targets;

hazard weapon means operable when activated to direct beams of simulated return fire at different areas of the player zone, said hazard weapon means emitting one active beam each time said hazard weapon means is activated whereby the game participant can evade each active beam by assuming a position in the player zone at which the active beam is not intercepted by the body of the game participant;

means for intermittently activating said hazard weapon means; and player hit indicating means for indicating when an active beam or simulated return fire is intercepted by the body of the game participant.

2. Apparatus as set forth in claim 1, including means for providing a warning signal to the game participant immediately prior to each activation of said hazard weapon means.

3. Apparatus as set forth in claim 1, including means for terminating the game when an active beam of simulated return fire is intercepted by the body of the game participant.

4. Apparatus as set forth in claim 3, including means for terminating the game when said target weapon has been triggered a predetermined number of times.

5. Apparatus as set forth in claim 1, wherein:

each target has an active state and an inactive state;

said apparatus includes means for intermittently placing said targets in the active state one at a time for a predetermined time; and said target hit indicating means provides a target hit indication only when said target weapon is triggered while aimed at a target in the active state.

6. Apparatus as set forth in claim 5, wherein:

each target has a light source energized in the active state of the target and deenergized in the inactive state of the target; and said means for intermittently placing said targets in the active state includes means for energizing said light sources one at a time in a predetermined sequence.

7. Apparatus as set forth in claim 6, including:

a light source associated with said target weapon operable to sense light from an energized light source at which said target weapon is aimed;

a light sensor circuit associated with said light sensor and providing an on target signal when said sensor senses light from an energized light source;

a trigger circuit associated with said trigger means and providing a shot signal each time said target weapon is triggered; and means for detecting when the on target and shot signals are present simultaneously to detect when said target weapon is triggered while aimed at an energized light source, said target hit indicating means providing a target hit indication in response to the simultaneous presence of the on target and shot signals.

8. Apparatus as set forth in claim 7, including:

means for terminating the game after a preselected number of shot signals; and means for permitting selective variation of the preselected number of shot signals necessary to terminate the game.

9. Electronic game apparatus for use by a game participant stationed in a player zone, said apparatus comprising:

a plurality of targets located outside of the player zone, each target having an active state in which the target emits light and an inactive state in which the target does not emit light;

means for intermittently placing said targets in the active state one at a time for a predetermined time;

means for placing each target in the inactive state after it has been in the active state for said predetermined time;

a hand held target weapon having trigger means for triggering said target weapon under the control of the game participant, said target weapon having photosensor means placed in a first condition when the target weapon is aimed at a target in the active state and a second condition when the target weapon is not aimed at a target in the active state;

visual display means for indicating when said target weapon is triggered with said photosensor means in the first condition;

a plurality of hazard weapons spaced apart from one another at locations outside of the player zone, each hazard weapon being operable to direct a beam toward a different area of the player zone;

means for intermittently placing said hazard weapons in an activated state one at a time for a preselected time; and indicating means for indicating when the beam emitted by any of said hazard weapons while in the activated state is intercepted by the person of the game participant.

10. Apparatus as set forth in claim 9, wherein said means for intermittently placing said hazard weapons in an activated state includes:

hazard weapon selector means having enabled and disabled conditions, said selector means being operable to activate a selected hazard weapon and to deactivate the remaining hazard weapons each time said selector means is placed in the enabled condition;

means for controlling which hazard weapon is selected for activation by said selector means each time the latter is placed in the enabled condition; and oscillator means for periodically cycling said hazard weapon between the enabled and disabled conditions at predetermined time intervals.

11. Apparatus as set forth in claim 10, including means for providing a warning signal to the game participant immediately prior to each enabling of said hazard weapon selector means.

12. Apparatus as set forth in claim 10, including:

means for establishing a predetermined number of times said target weapon can be triggered;

means for maintaining a running count of the number of remaining times said target weapon can be triggered; and means for disabling said oscillator means to maintain said selector means in the disabled condition after said target weapon has been triggered said predetermined number of times.

13. Apparatus as set forth in claim 12, wherein said controlling means includes:

means for sampling said running count to provide a sample number dependent upon the number of remaining times said target weapon can be triggered; and means for applying said sample number to said selection means to select the hazard weapon to be activated in accordance with the value of said sample number.

14. Apparatus as set forth in claim 9, including:

a hazard enable circuit for each hazard weapon providing a hazard enable signal for the corresponding hazard weapon each time the latter is placed in the activated state;

a beam intercept circuit for each hazard weapon providing a beam intercept signal for the corresponding hazard weapon each time the beam emitted therefrom is intercepted by the person of the game participant; and means for detecting when the hazard enable and beam intercept signals are present simultaneously for any hazard weapon, said indicating means providing a player hit indication in response to the simultaneous presence of the hazard enable and beam intercept signals for any hazard weapon.

15. Apparatus as set forth in claim 9, including:

a trigger circuit associated with said trigger means and providing a shot signal each time said target weapon is triggered;

a sensor circuit associated with said shot sensor means and providing an on target signal in the first condition of said photosensor means; and means for detecting when the on target and shot signals are present simultaneously, said visual display means providing a visual indication each time the on target and shot signals are present simultaneously.

16. Apparaus as set forth in claim 15, including:

means for establishing a preselected number of shot signals available;

means for visually displaying the number of shot signals remaining before said preselected number is reached;

means for counting the number of times the on target and shot signals are present simultaneously to provide a running count representative of the number of target hits that have occurred; and means for visually displaying the number of target hits that have occurred.

17. Apparatus as set forth in claim 9, including means for providing a test signal in response to the first condition of said photosensor means to test the aim of the target weapon without triggering same.

18. Apparatus as set forth in claim 17, including means for selectively disabling said test signal means.

19. Apparatus as set forth in claim 9, including means for effecting the inactive state of each target when said target weapon is triggered while said photosensor means is in the first condition.

20. A method of operating an electronic game played by an individual game participant stationed in a player zone of sufficient size to permit the game participant to assume different positions in the player zone, said method comprising the steps of:

providing a target;

intermittently placing the target in an active state for a predetermined time;

providing the game participant with a target weapon capable of being aimed at the target and triggered by the game participant;

indicating a target hit each time the target weapon is triggered while aimed at the target in the active state thereof;

periodically directing device beams of simulated return fire at different areas of the player zone, whereby each active beam is evaded if the participant assumes a position at which the beam is not intercepted by the person of the game participant; and providing a player hit indication when an active beam of the simulated return fire is intercepted by the person of the game participant.

* * * * *